US010588408B1

(12) United States Patent
Meeks

(10) Patent No.: US 10,588,408 B1
(45) Date of Patent: Mar. 17, 2020

(54) CONVERTIBLE BENCH/PICNIC TABLE

(71) Applicant: Jordan Forest Products, LLC, Mt. Gilead, NC (US)

(72) Inventor: Eddie Alexander Meeks, Greensboro, NC (US)

(73) Assignees: Robert B. Jordan, IV, Mt. Gilead, NC (US); Eddie Alexander Meeks, Greensboro, NC (US)

( * ) Notice: Subject to any disclaimer, the term of this patent is extended or adjusted under 35 U.S.C. 154(b) by 227 days.

(21) Appl. No.: 15/730,457

(22) Filed: Oct. 11, 2017

Related U.S. Application Data

(60) Provisional application No. 62/408,126, filed on Oct. 14, 2016.

(51) Int. Cl.
*A47B 85/04* (2006.01)
*A47C 13/00* (2006.01)
*A47B 83/02* (2006.01)

(52) U.S. Cl.
CPC ..... *A47B 83/024* (2017.08); *A47C 13/00* (2013.01); *A47B 85/04* (2013.01)

(58) Field of Classification Search
CPC ..... A47C 13/00; A47C 11/00; A47C 3/14; A47B 2220/07; A47B 85/04; A47B 83/02; A47B 2003/145
USPC ..... 297/124
See application file for complete search history.

(56) References Cited

U.S. PATENT DOCUMENTS 1,271,701 A * 7/1918 Griffith ..... A47C 11/00 297/244
1,532,417 A * 4/1925 Letts ..... A47B 39/04 297/126
1,542,770 A * 6/1925 Hess ..... A47C 11/00 297/440.1
1,757,960 A * 5/1930 Greenstreet ..... A47C 11/00 297/124
1,792,737 A * 2/1931 Greenstreet ..... A47B 83/02 297/124
1,818,428 A * 8/1931 Paysen ..... A47C 11/00 52/183
2,481,935 A * 9/1949 Larson ..... A47B 85/04 297/121
2,506,852 A * 5/1950 Barcus ..... A47B 85/04 297/121
2,558,465 A * 6/1951 Seymour ..... A47B 3/14 297/56

(Continued)

*Primary Examiner* — Kyle J. Walraed-Sullivan
(74) *Attorney, Agent, or Firm* — MacCord Mason PLLC

(57) ABSTRACT

A seating assembly having a bench configuration and a table configuration. The seating assembly comprises a bench having a seat with two rear legs that extend above the seat and a backrest mounted onto a spaced-apart pair of bases that are mounted on respective ones of the rear legs. Each rear leg includes a recess configured to receive a portion of one of the bases to support the backrest in the bench configuration. A pair of mounting posts are installed adjacent to the rear legs to hold respective ones of the bases and further include pivot pins extending through holes on each mounting post and extending through holes on one of each of the pair of bases. The backrest and bases can rotate about the pivot pin to switch between the bench configuration and the table configuration. Two seating assemblies may be combined to form a full-sized table.

25 Claims, 14 Drawing Sheets

(56) References Cited

U.S. PATENT DOCUMENTS 2,561,703 A * 7/1951 Koenig ..... A47B 85/04 297/121
2,642,925 A * 6/1953 Seymour ..... A47B 3/14 297/56
D181,727 S * 12/1957 Haynes ..... D6/342
2,856,985 A * 10/1958 Lepper ..... A47B 83/02 297/124
2,922,463 A * 1/1960 Johnston ..... A47B 83/02 297/124
3,256,037 A * 6/1966 Giambalvo ..... A47B 3/14 297/158.4
3,429,283 A * 2/1969 Uhor ..... A47B 3/14 108/11
4,046,417 A * 9/1977 Beckley ..... A47B 85/04 297/16.1
D248,903 S * 8/1978 O'Connor ..... D6/337
4,194,784 A * 3/1980 Dostal ..... A47B 83/02 297/126
4,211,449 A * 7/1980 Richardson ..... A47C 13/00 297/126
4,382,627 A * 5/1983 Dean ..... A47C 13/00 297/121
4,615,559 A * 10/1986 Blondeau ..... A47B 3/14 297/124
4,647,107 A * 3/1987 Hoover ..... A47B 83/02 297/124
4,662,675 A * 5/1987 Volpi ..... A47C 11/00 297/124
4,801,175 A * 1/1989 Albanese ..... A47B 85/04 297/124
4,913,488 A * 4/1990 Donnell, Jr. ..... A47B 85/04 297/124
D313,128 S * 12/1990 Serafini ..... D6/338
5,292,172 A * 3/1994 Watts ..... A47B 85/00 297/125
D368,171 S * 3/1996 Snell ..... D6/335
5,704,683 A * 1/1998 Cooper ..... A47B 85/04 297/124
5,823,616 A * 10/1998 Scott ..... A47B 83/02 297/158.2
6,135,545 A * 10/2000 Liao ..... A47C 17/17 297/124
D435,736 S * 1/2001 Chrisco ..... D6/336
6,189,965 B1 * 2/2001 Hecht ..... A47B 85/00 297/124
D439,422 S * 3/2001 Hecht ..... D6/336
6,231,121 B1 * 5/2001 Chrisco ..... A47B 85/04 297/124
6,241,312 B1 * 6/2001 Watts ..... A47B 3/14 297/125
6,299,251 B1 * 10/2001 Harper ..... A47C 4/04 297/331
D470,666 S * 2/2003 Peloquin ..... D6/336
6,659,543 B2 12/2003 McCutcheon et al. ..... 297/127
7,226,125 B2 * 6/2007 Frobose ..... A47B 3/14 297/158.4
7,533,940 B1 * 5/2009 Zook ..... A47B 83/02 297/440.13
8,550,547 B1 * 10/2013 Liu ..... A47C 7/70 297/121
8,720,990 B2 5/2014 Boydston ..... 297/173
10,206,496 B1 * 2/2019 Miller ..... A47B 39/06
2002/0140257 A1 * 10/2002 Liu ..... A47B 3/14 297/124
2003/0197402 A1 * 10/2003 McCutcheon ..... A47B 85/04 297/125
2005/0253424 A1 * 11/2005 Thomas ..... A47B 85/04 297/119
2008/0018142 A1 * 1/2008 Yul ..... A47B 3/14 297/158.4
2009/0261629 A1 * 10/2009 Fafard ..... A47C 1/03211 297/105
2011/0057483 A1 * 3/2011 Dickey ..... A47B 3/14 297/124
2011/0316312 A1 * 12/2011 Boydston ..... A47B 85/04 297/173
2014/0225401 A1 * 8/2014 Nellenbach ..... A47B 3/14 297/158.4
2016/0338491 A1 * 11/2016 Demichael ..... A47C 11/00
2017/0273452 A1 * 9/2017 Smith ..... A47B 3/14

* cited by examiner

CONVERTIBLE BENCH/PICNIC TABLE

This application claims the benefit of U.S. Provisional Patent Application 62/408,126 filed Oct. 14, 2016, which is incorporated herein by reference in its entirety.

BACKGROUND OF THE INVENTION

The present invention relates to a seating assembly having a bench configuration and a table configuration. Benches offer a convenient means for sitting to enjoy the outdoor scenery. Picnic tables are ideal for people gathering together to share meals and beverages. Benches are typically accompanied with a backrest for additional support and comfort, while picnic tables commonly forgo a backrest for easier accessibility. Typically, benches and picnic tables are sold as separate outdoor pieces. Various convertible benches/tables are available to provide the benefits of both, but suffer from numerous issues. For example, convertible benches/tables are commonly constructed from a metal frame, which can be less desirable for consumers seeking furniture with a natural aesthetic. Other assemblies may suffer from stability issues, or are difficult and cumbersome to switch between configurations. Thus, there remains a need for a convertible bench/picnic table that is easy to install while constructed to remain sturdy in either configuration.

SUMMARY OF THE INVENTION

The present invention fulfills one or more of these needs in the art by providing a seating assembly having a bench configuration and a table configuration. In one embodiment, the seating assembly is a bench comprising a seat with two rear legs that extend above the seat and a backrest mounted onto a spaced-apart pair of bases. The bases are mounted on respective ones of the rear legs, with each rear leg including a recess configured to receive a portion of one of the bases to support the backrest in the bench configuration. A pair of mounting posts may be installed adjacent to the rear legs to hold respective ones of the bases, and further include pivot pins extending through holes on each mounting post and extending through holes on one of each of the pair of bases. A locking assembly is included to secure the backrest when the bench is in the table configuration to support the bases horizontally. In operation, the backrest and bases can rotate about the pivot pin to switch between the bench configuration and the table configuration.

The seating assembly may be comprised of wood. For example, the seat may comprise a plurality of boards mounted perpendicularly across a pair of lateral trusses. Similarly, the backrest may comprise a plurality of boards spanning the bases.

The bases may be of various shapes and sizes. For example, the bases may have a front face and a bottom face and the front face is at an angle greater than 90° to the bottom face. In one embodiment, each base comprises two base elements that straddle an upper end of the mounting post.

In some embodiments, the mounting posts are supported by the lateral trusses. The bases may be located either adjacent to interior faces of the mounting posts, or to the exterior faces of the mounting posts. The mounting posts may be comprised of a wooden board. In other embodiments, each mounting post may comprise a wooden board inserted into a plastic cap, wherein the plastic cap includes the holes for the pivot pins to extend through. Similarly, in some embodiments, the bases may be comprised of wood. In other embodiments, the bases may comprise plastic. For example, the bases may be formed from an injection-molded process.

Locking pins may be provided as a locking assembly, wherein they are configured to be inserted in holes in the mounting post when the bench is in the table configuration to support the bases horizontally, and may be chained to the seat assembly to prevent loss or theft. In other embodiments, the locking assembly comprises a bolt action lock assembly. The bolt action lock assembly may include a locking pin configured to be inserted into a slot in each base. The locking pin may be slid between a first position and a second position within the slot. The first position enables the backrest and bases to rotate between the bench configuration and the table configuration, while the second position secures the backrest when the bench is in the table configuration to support the bases horizontally.

The seating assembly may also be adapted to form a full-sized table with a second seating assembly. For example, the seating assembly may include a first lock piece on its backrest configured to connect with a second lock piece on a backrest of the second seating assembly to form a full-sized table.

In one embodiment, the first lock piece includes a hook and the second lock piece includes a recess adapted to receive the hook of the first lock piece. The second lock piece also includes a ridge to retain the hook of the first lock piece. A spacing on the second lock piece may be included to enable a user to push on the second lock piece to release the hook from the ridge and the recess when attempting to separate the seating assemblies.

In another embodiment, the first lock piece and the second lock piece are configured to overlap with one another forming a hole. A pin is inserted into the hole formed from the first lock piece and the second lock piece to secure the first seating assembly to the second seating assembly and thereby form a full-sized bench.

The invention can also be considered as a method for converting a backrest of a bench into a table by orienting a backrest mounted on a pivot on a pair of mounting posts installed adjacent to a pair of rear legs in an inclined position to serve as a backrest, rotating the backrest to a horizontal position substantially parallel to the ground, and inserting a pin into a hole on each pair of mounting posts so the backrest is at least partially supported on the pair of pins.

The invention can also be considered as a method for converting a picnic table into a bench by removing a supporting pin from a pair of mounting posts installed adjacent to a pair of rear legs, and rotating a horizontal tabletop about a pivot point on the mounting posts to an inclined vertical position to place the tabletop so portions of the tabletop are at least partially supported by recesses in the pair of rear legs. The method may also include the steps of aligning an end of the horizontal tabletop with an end of a second tabletop and securing the end of the horizontal table top with the end of the second tabletop to form a full-sized table. Securing the ends may be accomplished by connecting a first lock piece on the end of the horizontal table top with a second lock piece on the end of the second tabletop.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
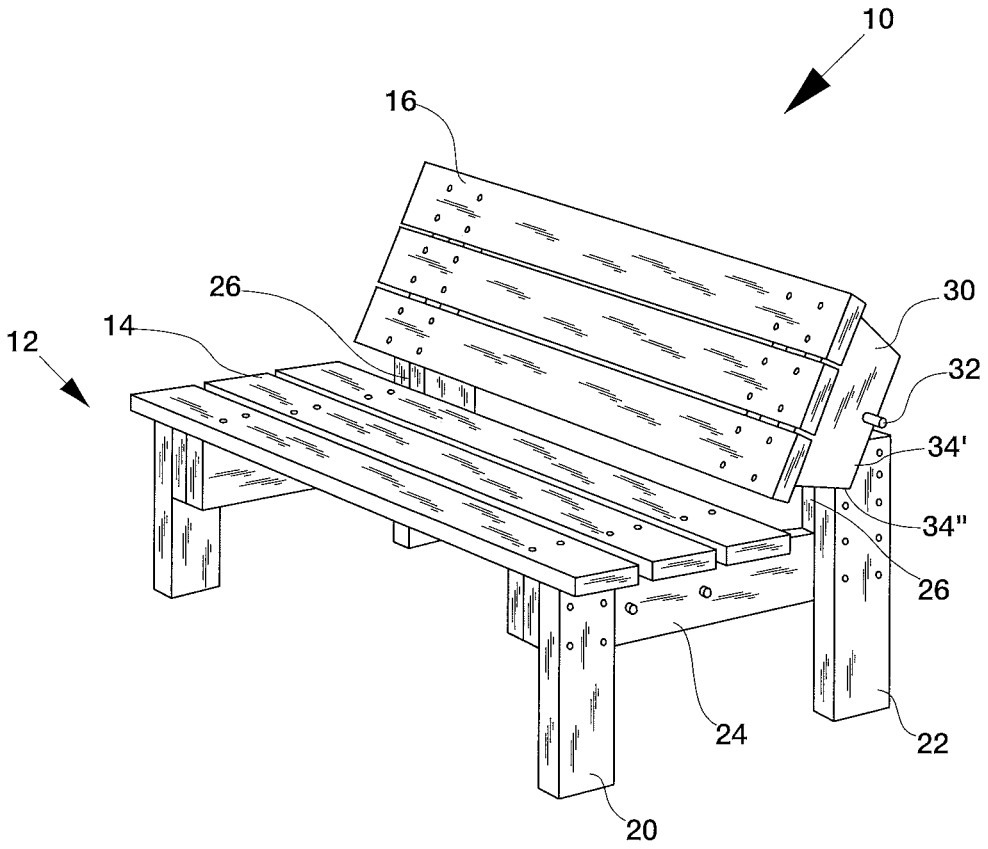
FIG. 1 is an overhead perspective view of a seating assembly in a bench configuration as constructed according to one embodiment.

FIG. 1 shows one embodiment of a seating assembly 10 in a bench configuration. Seating assembly 10 comprises a bench 12 having a seat 14 and a backrest 16. In the embodiment shown, bench 12 is formed from a pair of front legs 20 and a pair of rear legs 22 that are spanned by a pair of lateral trusses 24. Other embodiments of bench 12 may comprise different types of frames, such as including additional trusses and legs to support the seating assembly.

As seen in FIG. 1, seat 14 and backrest 16 each comprises a plurality of boards. The boards of seat 14 are mounted across lateral trusses 24, while the boards of backrest 16 are mounted onto bases 30. Preferably, each board has been continuous, kiln dried, patterned, reverse grooved, and end matched. A preferred board species is Southern yellow pine. Preferably the boards have had "EcoLife" treatment with a non-metallic preservative and stabilizer system. EcoLife treatment provides an environmentally friendly protection that is expected to prevent rot for over 30 years. EcoLife treatment is available from Viance LLC of Charlotte, N.C. and is a non-metallic preservative and stabilizer system, offering the natural beauty of real wood combined with advances in weathering protection and fastener performance.

Backrest 16 is mounted onto a pair of bases 30 that are supported by rear legs 22, including mounting posts 26. Seating assembly 10 includes pivot pins 32 on each rear side of bench 12, enabling switching between the bench and table configurations. Pivot pins 32 enable backrest 16 to rotate from a horizontal position to a slanted vertical position and vice versa. In the bench configuration, backrest 16 is oriented in a slanted vertical position as seen in FIG. 1 to support a user's back while sitting on seat 14. Rear legs 22 include a recess 34 adapted to receive base 30 and define an angle for backrest 16. As seen in the embodiment in FIGS. 1 and 2, bases 30 have a front face 130 and a bottom face 131 with the front face at an angle greater than 90° to the bottom face. Recess 34 is shaped to support the bottom 131 of base 30 and prevent backrest 16 from tilting at an undesirable angle. Desirably, the recess 34 and the angle of faces 130,131 are complimentary, as seen in FIG. 1. Other embodiments may include a rectangular base having a recess 34 enabling backrest 16 to tilt at a vertical position perpendicular to the ground. Alternative embodiments may also include base 30 and recess 34 being at least partially rounded.

Figure 2:
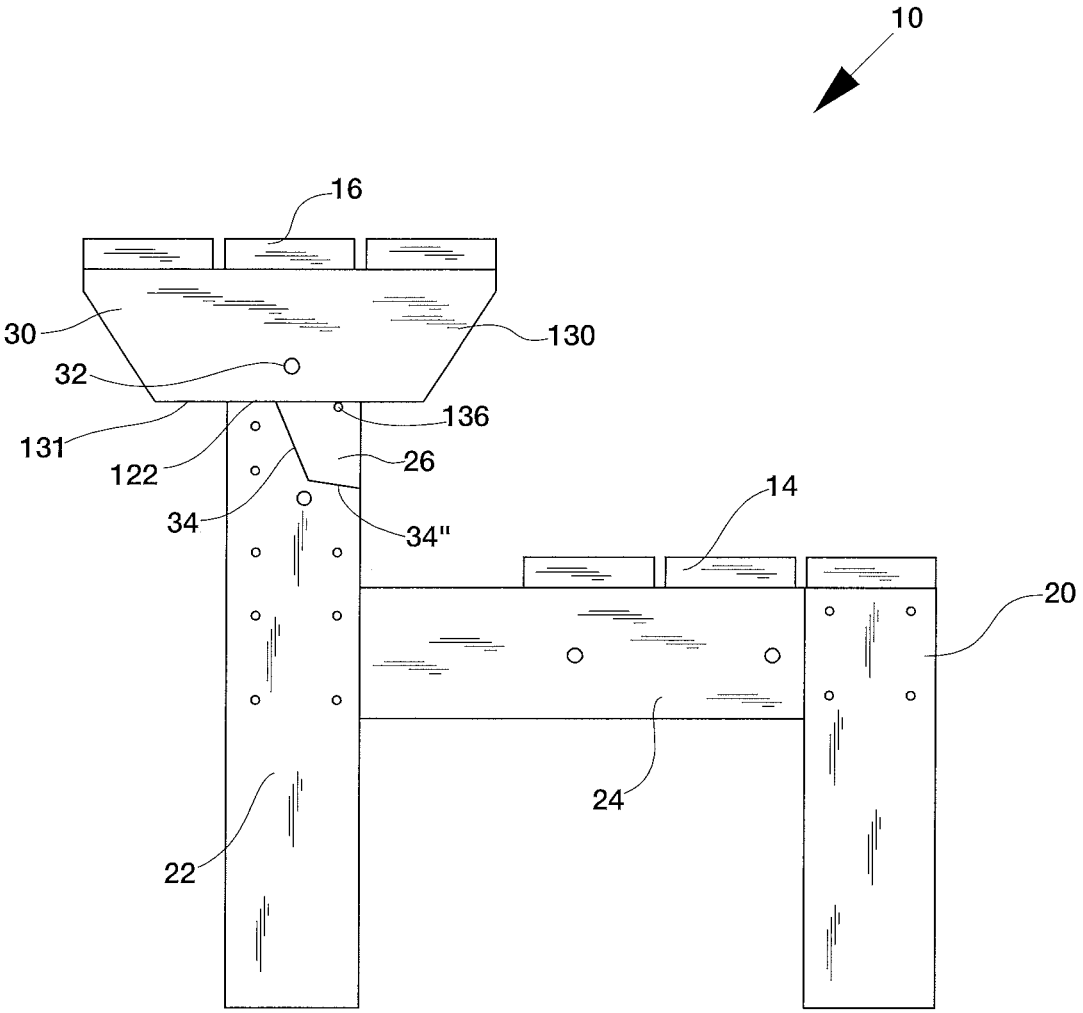
FIG. 2 is a side elevational view of the embodiment in FIG. 1 in a table configuration.
Figure 3:
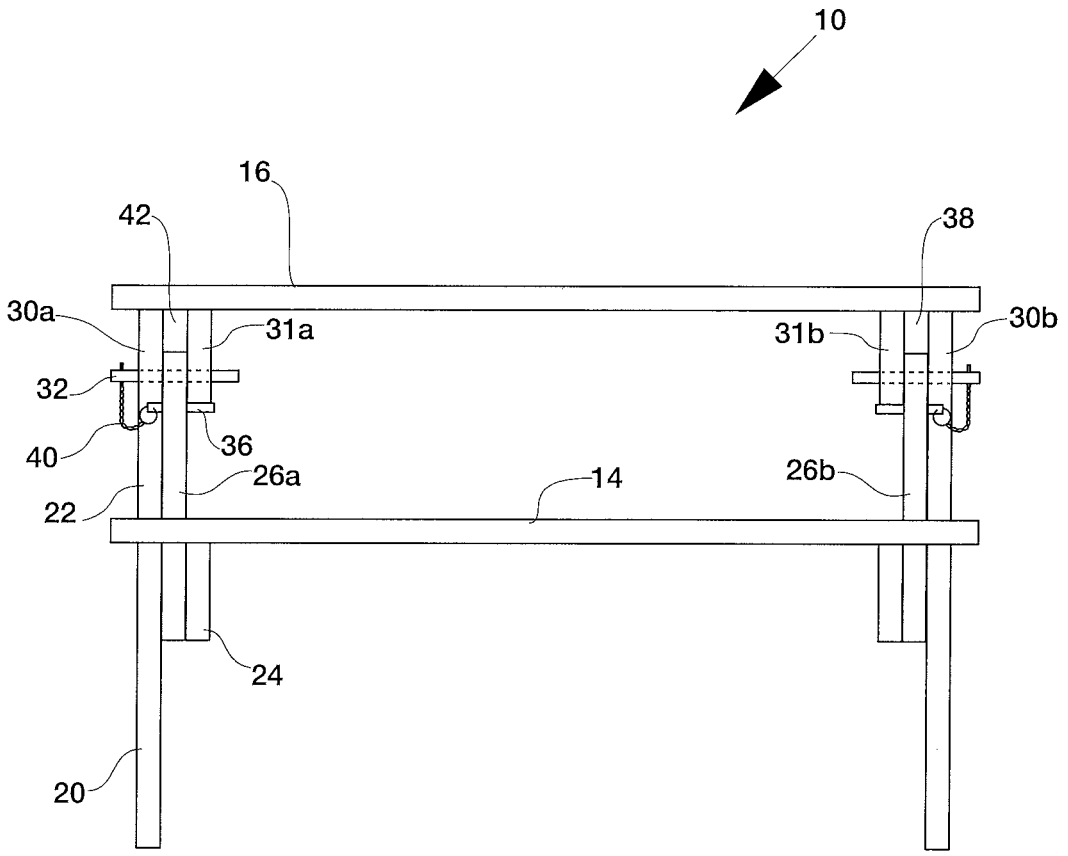
FIG. 3 is a front elevational view of the embodiment in FIG. 1 in a table configuration.

FIGS. 2 and 3 illustrate seating assembly 10 in its table configuration. Turning to FIG. 2, backrest 16 is shown in a horizontal orientation and adapted for use as a tabletop. In some embodiments, base 30 may further include a secondary base 31 to provide additional stability to backrest 16. As shown in FIG. 3, bases 30*a* and 30*b* respectively include secondary bases 31*a* and 31*b* that are each separated by a distance 42 adapted to receive an upper end of the mounting posts 26*a* and 26*b*. Inserting mounting posts 26*a* and 26*b* in between bases 30*a* and 31*a* and 30*b* and 31*b*, respectively, further prevent backrest 16 from shifting in a lateral direction and provides additional structural stability. Embodiments having a single pair of bases 30 may have them installed on either the exterior or interior faces of mounting post 16. Shown in FIG. 3, mounting posts 26 are supported by lateral trusses 24, but may be supported by other structures or the ground in other embodiments.

Figure 4:
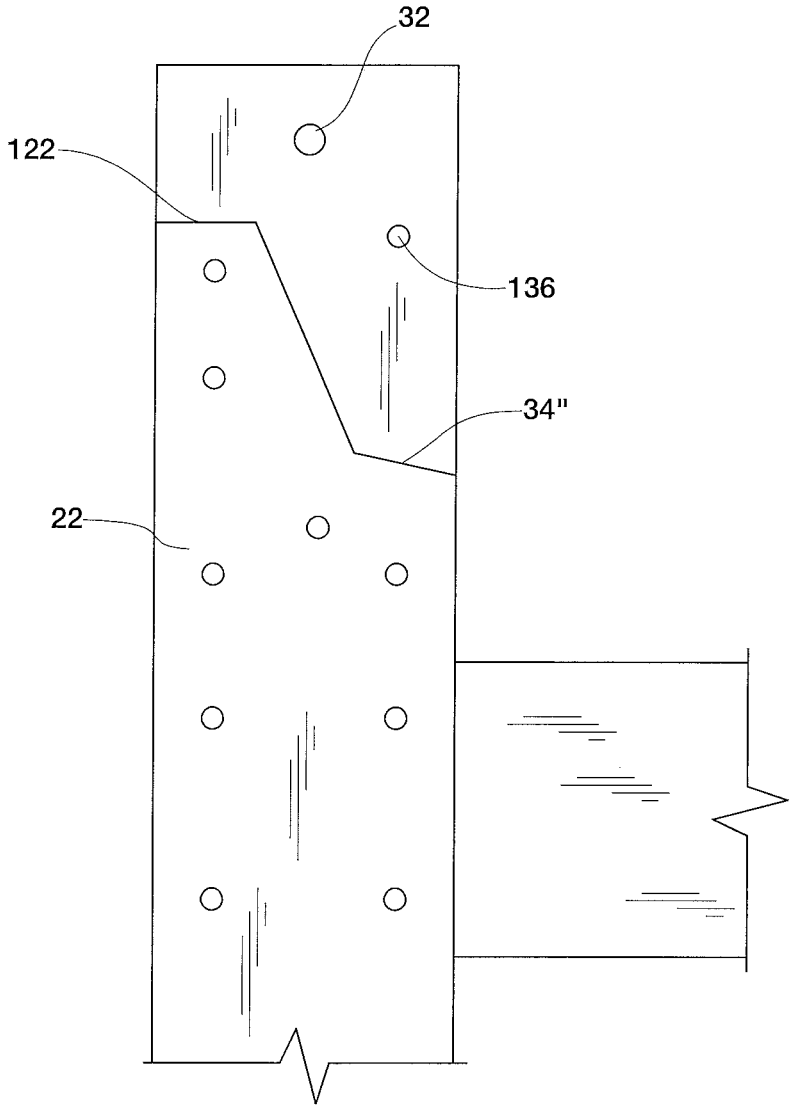
FIG. 4 is a side elevational view of the embodiment of FIG. 1, with the backrest/tabletop removed.

As seen in FIG. 3, mounting posts 26 and bases 30,31 each include holes 38 that align and are configured for receiving pivot pin 32. Pivot pins 32 are inserted through holes 38 in bases 30, 31 and mounting post 26 (shown as dashed lines along pivot pin 32) to enable backrest 16 to rotate from its vertical position in the bench configuration. Pivot pins 32 also provide one means for supporting backrest 16 onto mounting post 26. Mounting posts 26 also include locking pins 36 that provide support for backrest 16 when it is positioned in its table configuration. As backrest 16 transitions from the bench configuration to the table configuration, locking pins are inserted through a hole 136 in mounting post 26. Once the backrest 16 is in a horizontal orientation, bases 30 and 31 rest on top of locking pin 36 and on top 122 of the rear leg 22 (see FIG. 4). Locking pin 36 may be attached to pivot pin 32 using a chain 40 to prevent losing locking pin 36 when seating assembly 10 is in its bench configuration and locking pin 36 is not needed.

Figure 5A:
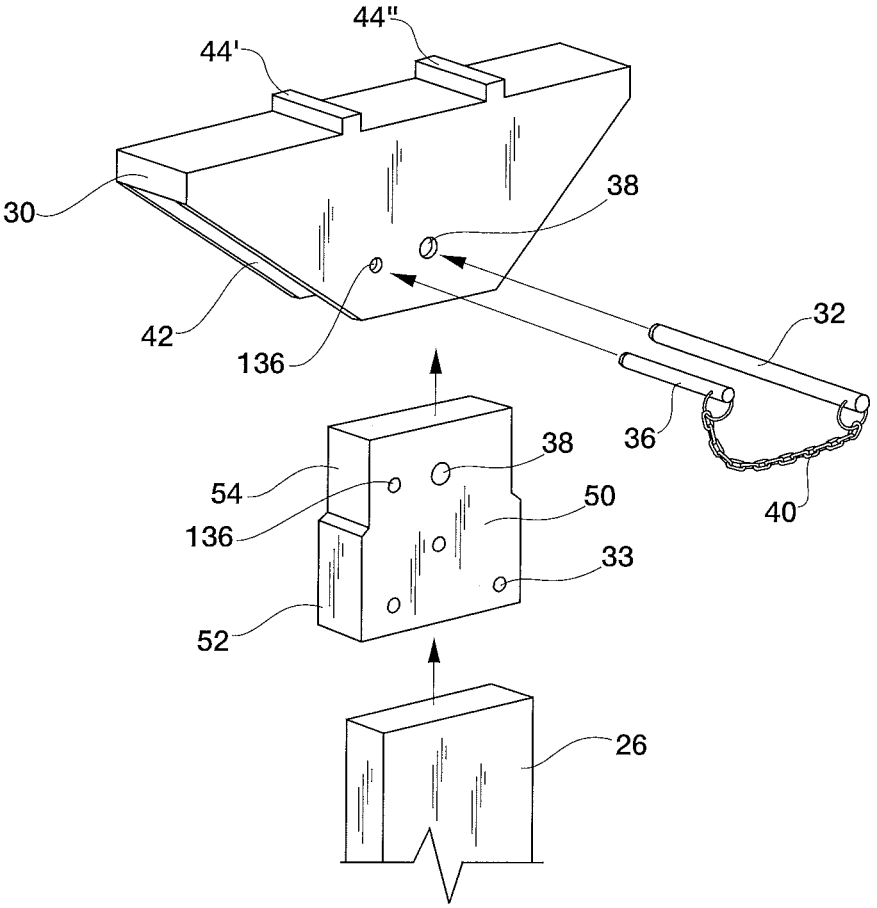
FIG. 5A is an exploded view of an injection-molded base having a pivot pin and locking pin as constructed according to another embodiment.
Figure 5B:
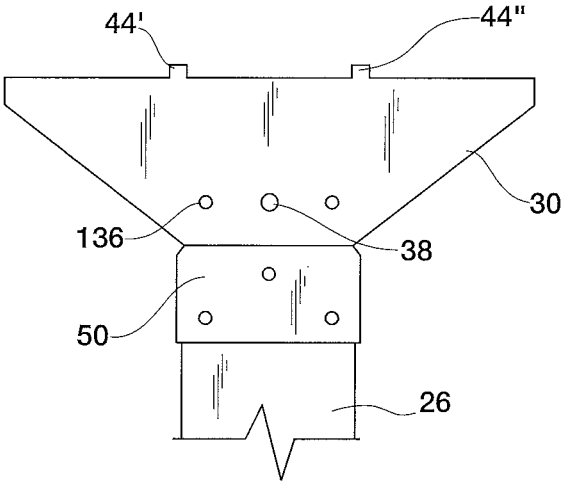
FIG. 5B is an enlarged front view of the embodiment in FIG. 5A.

Generally, wood may expand, contract, and warp over time due to various temperature and weather conditions. While these behaviors may add character to the wood, it may be less desirable for certain functional components of the seating assembly to deviate over time. Alternative embodiments may therefore include various components of the seating assembly formed of plastic to ensure product consistency during production and product durability. FIGS. 5A and 5B illustrate one example of an injection-molded base 30 and an injection-molded cap 50. Base 30 includes ribbings 44' and 44" receiving boards to make up the backrest 16. Mounting post 26 is inserted into a first end 52 of cap 50 and may be fastened by screws in holes 33. The opposing end 54 of cap 50 is inserted into recess 42 of base 30. Both base 30 and cap 50 include holes 38 that align to permit insertion of pivot pin 32, and further include holes 136 that overlap for insertion of locking pin 36.

Figure 6A:
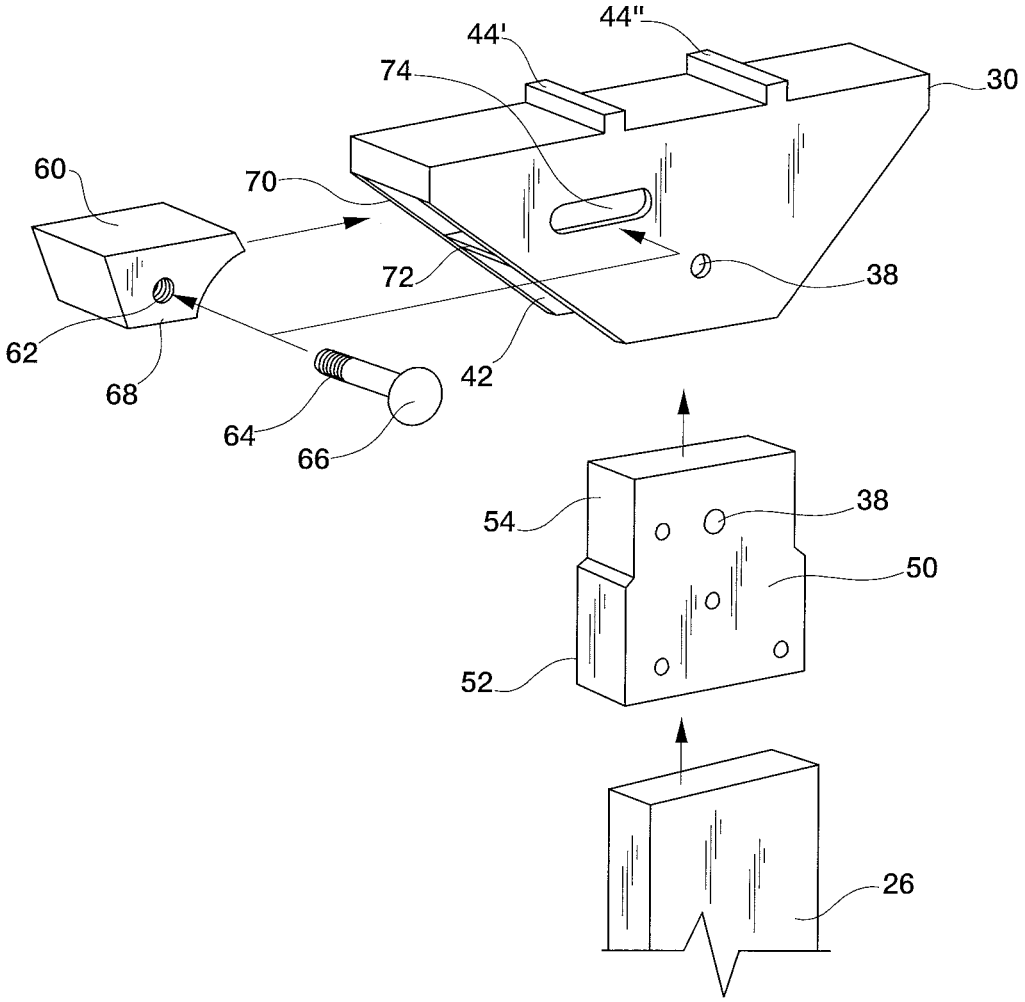
FIG. 6A is an exploded view of an injection-molded base having a bolt-action lock as constructed according to another embodiment.
Figure 6B:
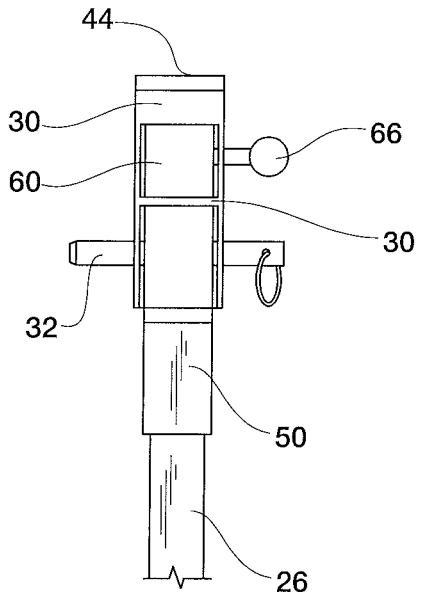
FIG. 6B is an enlarged side view of the embodiment in FIG. 6A.
Figure 6C:
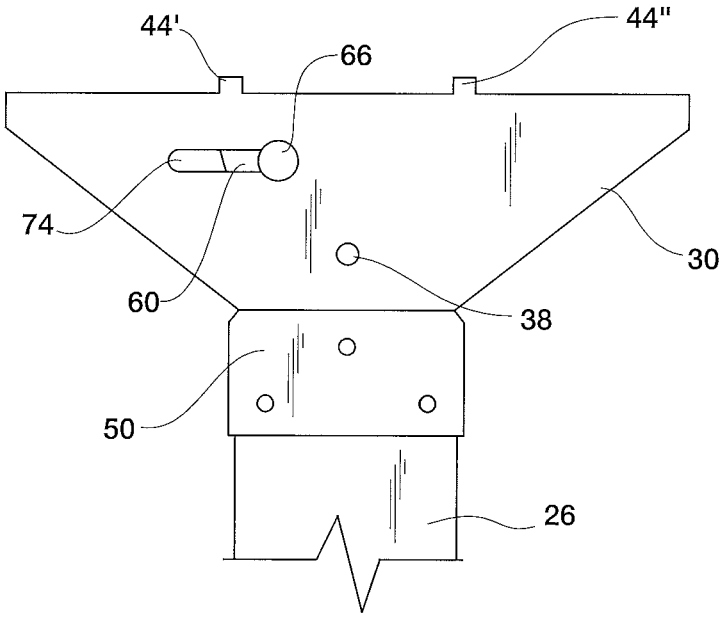
FIG. 6C is an enlarged front view of the embodiment in FIG. 6A.

Alternative embodiments may employ other mechanisms for pivoting and securing backrest 16 into a particular configuration. Turning to FIGS. 6A-6E, another embodiment is shown utilizing a bolt action lock assembly to convert seating assembly 10 into either a bench or table configuration. The cap 50 can be the same as the cap 50 of FIG. 5A. Base 30 in FIG. 6A is different than in FIG. 5A. The bolt action lock assembly comprises a lock piece 60 having a threaded recess 62 adapted to receive bolt 64. Bolt 64 includes a knob 66 for a user to use to modify the position of the bolt action lock assembly. Lock piece 60 is inserted into small recess 70 of base 30 that is separated from recess 42 by wall 72. Knob 66 extends through slot 74. Base 30 includes a hole 38 for receiving pivot pin 32 enabling rotation of backrest 16.

Figure 6D:
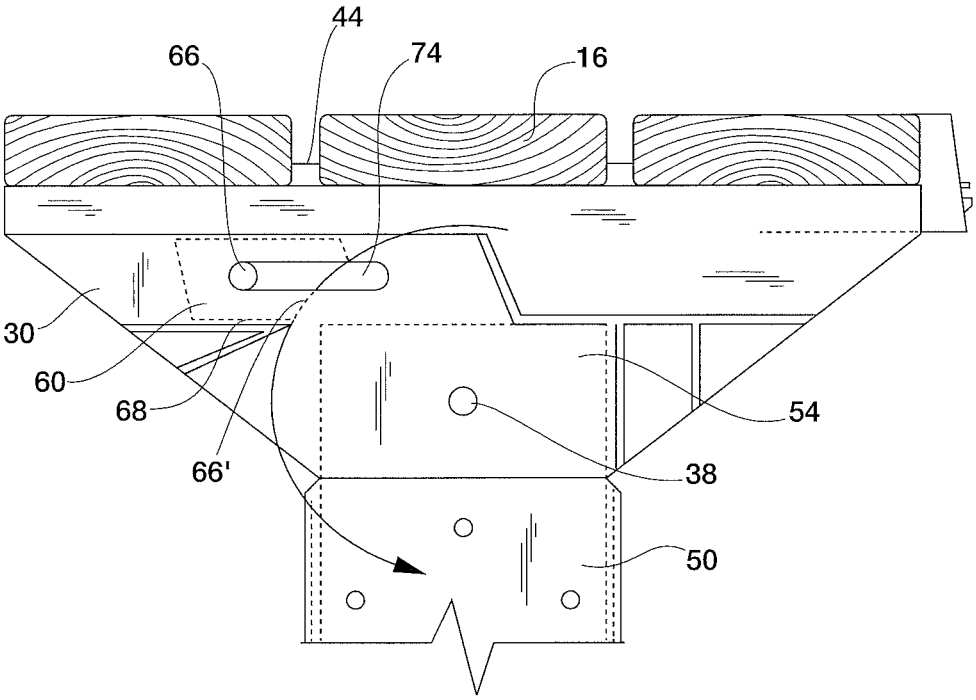
FIG. 6D is a front sectional view of the embodiment in FIG. 6A with the bolt-action lock in a first position to enable rotation of the backrest/tabletop.
Figure 6E:
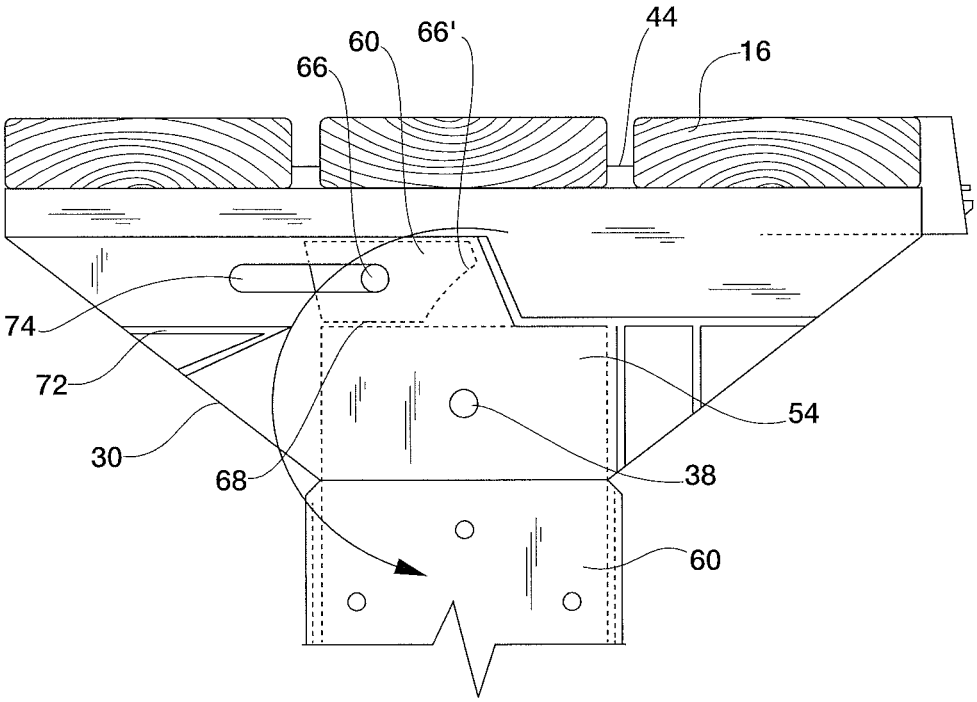
FIG. 6E is a front sectional view of the embodiment in FIG. 6A with the bolt lock in a second position to prevent rotation of the base.

FIGS. 6D and 6E are partial sectional views through the base 30 to show the operation of the bolt action lock assembly. FIG. 6D illustrates the lock piece 66 in a first position enabling backrest 16 to rotate about pivot pin 32 between a bench configuration and a table configuration. Because lock piece 66 is positioned away from pivot pin 38 and cap 50, the backrest 16 on base 30 is free to rotate about pivot pin 32 in holes 38. In this first position, the lower surface 68 of lock piece 66 rests on wall 72 and curved inside wall 66' allowing the upper left corner of the cap 50 to clear past the lock piece 66 as it rotates. FIG. 6E illustrates lock piece 66 in a second position preventing backrest 16 from rotating about pivot pin 32, and is used to secure backrest 16 in a table configuration. In the second position, lower surface 68 of lock piece 60 directly abuts the top surface 54 of cap 50 with lock piece 66 positioned between cap 50 and base 30 to prevent backrest 16 from pivoting.

Figure 7A:
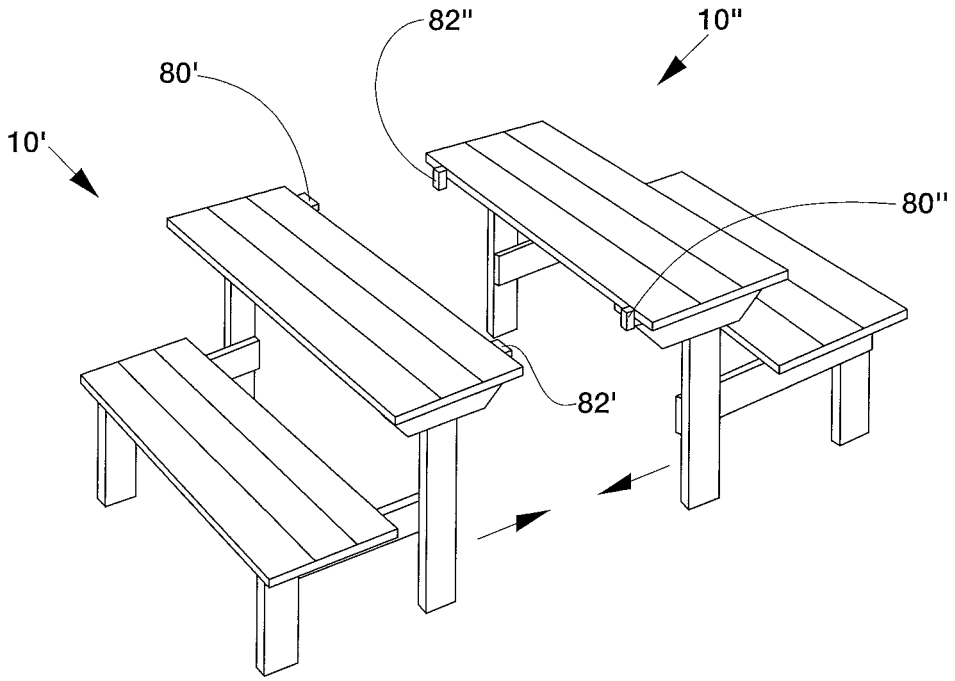
FIG. 7A is an overhead perspective view of two seating assemblies in table configurations spaced apart but aligned to form a full-sized table as constructed according to one embodiment.
Figure 7B:
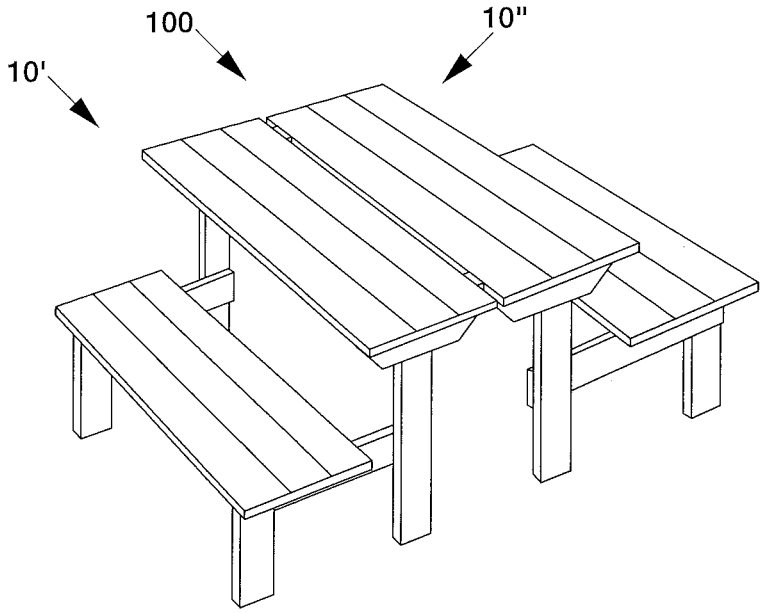
FIG. 7B is an overhead perspective view of the two seating assemblies in FIG. 7A forming a full-sized table.

In some embodiments, two seating assemblies may be combined to form a full-sized table. FIG. 7A depicts seating assemblies 10' and 10" in their respective table configurations. In the embodiment shown, each seating assembly includes a first lock piece 80 and second lock piece 82 on a surface of backrest 16. As seen in FIG. 7B, the first lock pieces 80 and second lock pieces 82 attach to one another securely to enable the two assemblies 10' and 10" to form full-sized table 100.

Figure 8A:
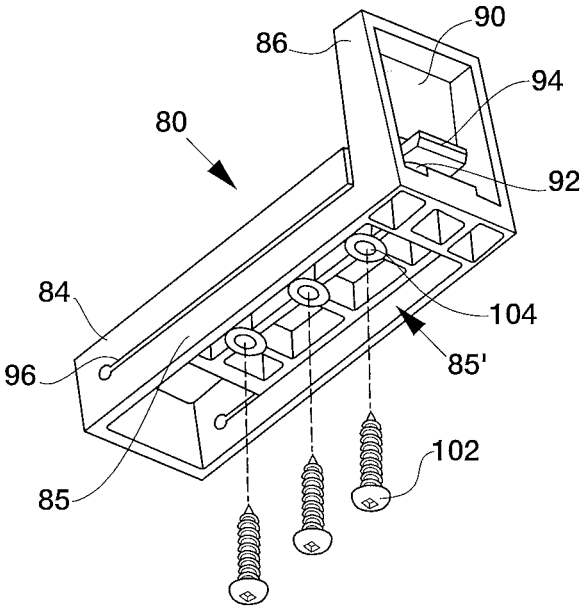
FIG. 8A is a perspective view of a first lock piece constructed according to one embodiment.
Figure 8B:
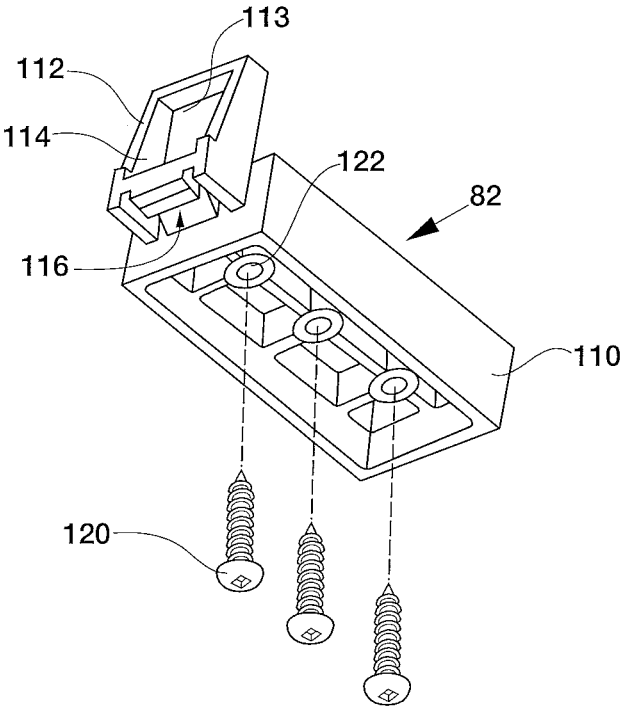
FIG. 8B is a perspective view of a second lock piece constructed according to one embodiment.

Turning to FIGS. 8A and 8B, embodiments of a first lock piece 80 and second lock piece 82 are shown, respectively. FIG. 8A depicts an embodiment wherein first lock piece 80 is a female lock piece formed from plastic, such as injection molded plastic. In this embodiment, first lock piece 80 comprises an upper longitudinal section 84 adapted to be mounted onto backrest 16 and a lower longitudinal section 85. It also has a vertical portion 86 adapted to receive a second male lock piece 82. Vertical portion 86 includes a first recess 90 and a second recess 92. First lock piece 80 also includes a guide pin 94 to facilitate connecting with second lock piece 82. First lock piece 80 may be mounted onto the top most board of the backrest 16 by inserting fasteners 102 through holes 104 formed in the upper longitudinal section 84. Access to the holes 104 is available because of an open area 85' in section 85. This causes the vertical portion 86 to project from the edge of the top board. Preferably, vertical portion 86 is no taller than the thickness of the top board, so it does not project against a user's back while in the bench configuration. The upper and lower longitudinal sections 84 and 85 are thus joined at an end away from the vertical portion 86, making a resilient flexing possible between the sections 84 and 85.

FIG. 8B depicts an embodiment wherein second lock piece 82 is a male lock piece formed from plastic and adapted to mate with the first lock piece 80 shown in FIG. 8A. In this embodiment, second lock piece 82 includes a longitudinal section 110 adapted to be mounted onto the top board of a backrest in similar fashion to the first lock piece 80, but positioned to be complimentary with a first lock piece of any other table/bench it mounts to. Vertical portion 112 may include a recessed portion 113 having a slot 114 adapted to fit under guide pin 94. Second lock piece 82 also includes a hook 116 for insertion into second recess 92 and under guide pin 94 of first lock piece 80. Second lock piece 82 may be mounted onto backrest 16 by inserting fasteners 120 through holes 122.

Figure 9A:
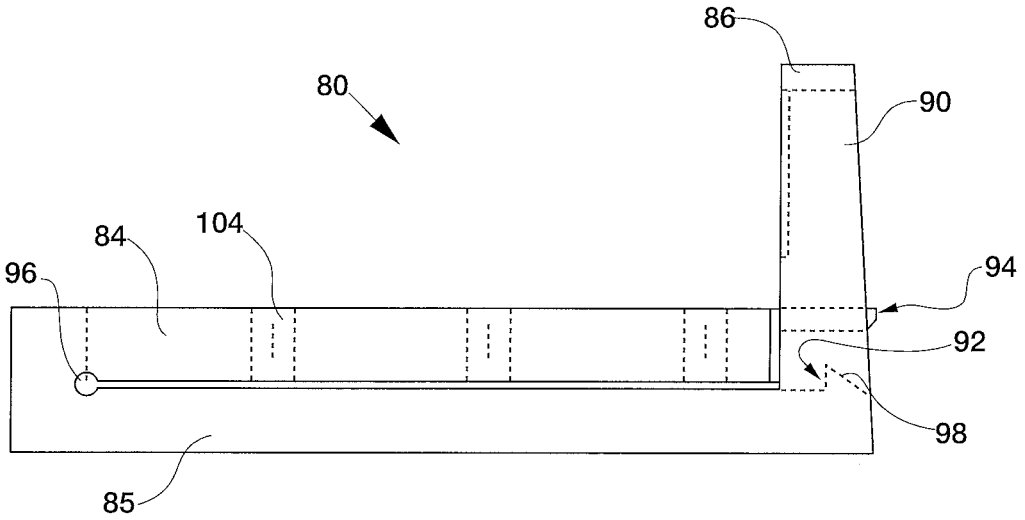
FIG. 9A is a side elevational view of the first lock piece embodiment in FIG. 8A with parts shown in phantom.
Figure 9B:
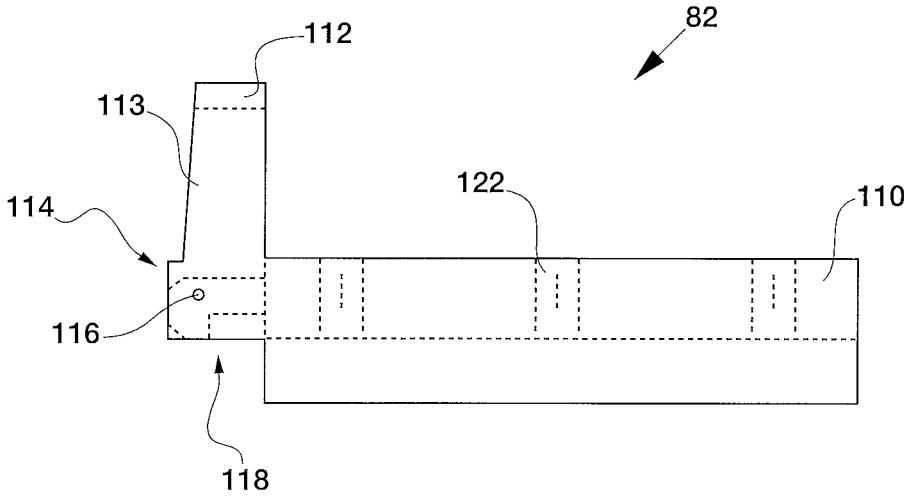
FIG. 9B is a side elevational view of the second lock piece embodiment in FIG. 8B with parts shown in phantom.
Figure 10:
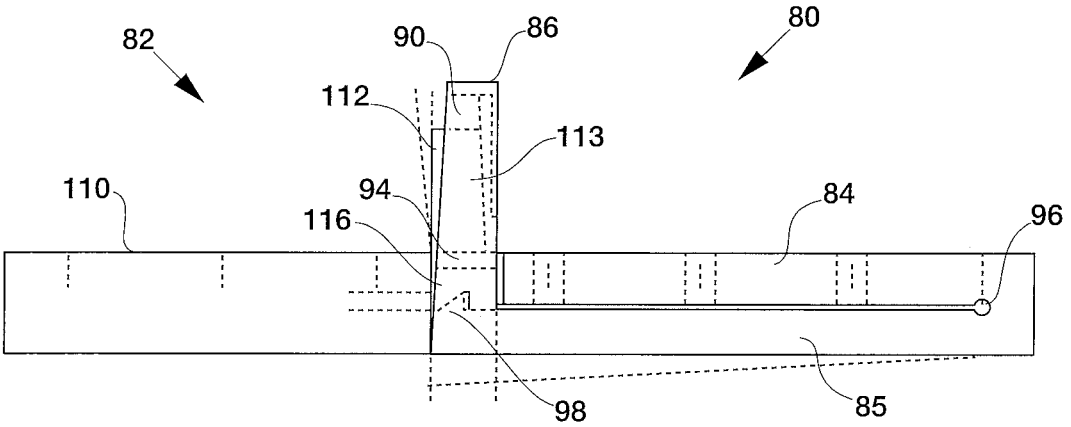
FIG. 10 is a side sectional view of the first lock piece connecting with the second lock piece.

FIGS. 9A, 9B and 10 depict sectional side views of the first and second lock piece embodiments of FIGS. 8A and 8B, respectively. As seen in FIG. 9A, first lock piece 80 includes a gap 96 between upper longitudinal section 84 and lower longitudinal section 85. If section 85 is flexed away from section 84, it permits release of hook 116 inserted into recess 92. First lock piece 80 also includes guide pin 94 above recess 92. FIG. 9B shows slot 114 above hook 116 for receiving guide pin 94. Below slot 114, the distal end of hook 116 creates a cavity 118 for ridge 98 to secure hook 116. If vertical portion 80 is pressed downward, the ridge 98 clears the hook 116, enabling separation of the two assemblies 10' and 10".

Figure 11A:
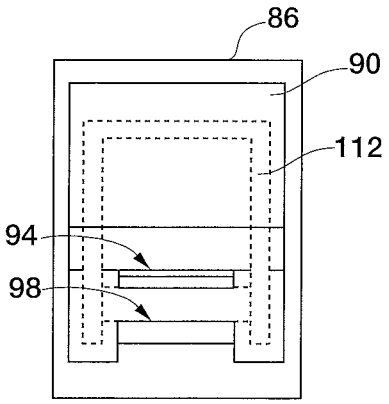
FIG. 11A is an end view of the first lock piece embodiment in FIG. 10.
Figure 11B:
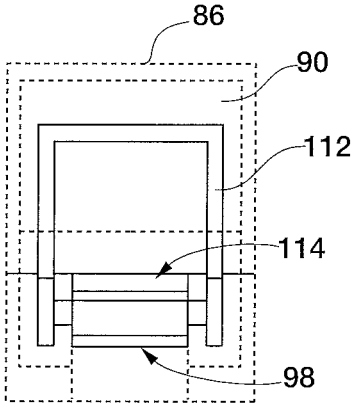
FIG. 11B is an end view of the second lock piece embodiment in FIG. 10.

FIG. 10 illustrates the first and second lock pieces interconnected, wherein hook 116 is inserted into recess 92 and secured by ridge 98 within cavity 118. Vertical portion 112 is inserted into recess 90 of vertical portion 86, enabling guide pin 94 to be inserted into slot 114. FIGS. 11A and 11B show front sectional views for the first and second lock pieces, respectively, and provide additional perspective for how the various components interlock. To separate the first and second lock pieces, vertical portion 86 is pushed downward. While longitudinal section 84 remains mounted onto backrest 16, spacing 96 enables a portion of longitudinal section 84 and vertical piece 86 to displace downward. As vertical piece 86 displaces downward, ridge 98 is lowered, thereby enabling hook 116 and second lock piece 82 to pull away from first lock piece 80.

Figure 12A:
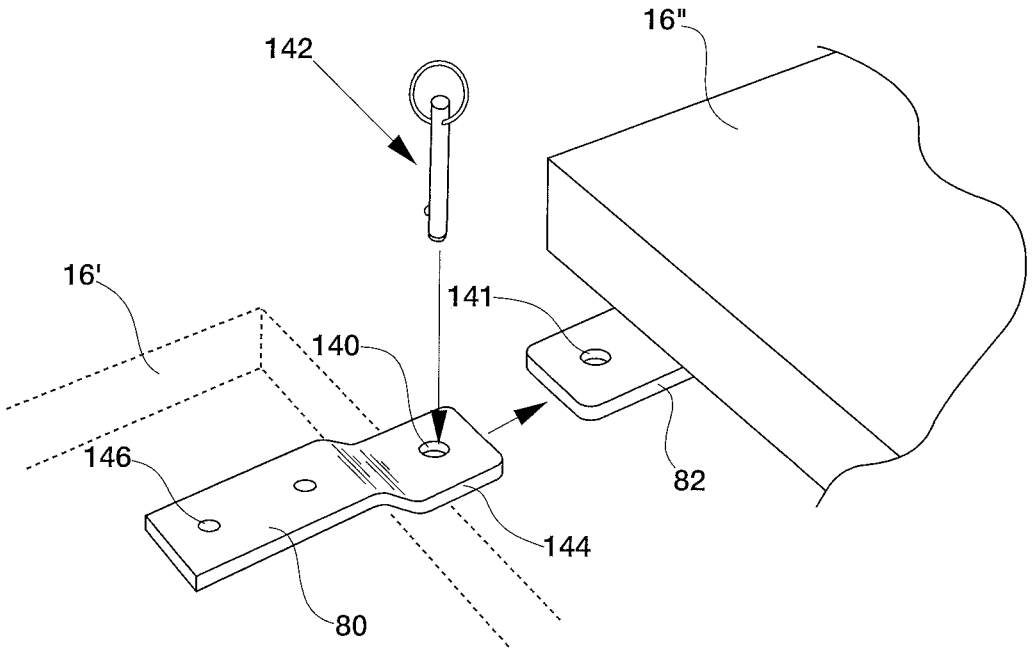
FIG. 12A is an overhead perspective view of a first lock piece and second lock piece constructed according to another embodiment.
Figure 12B:
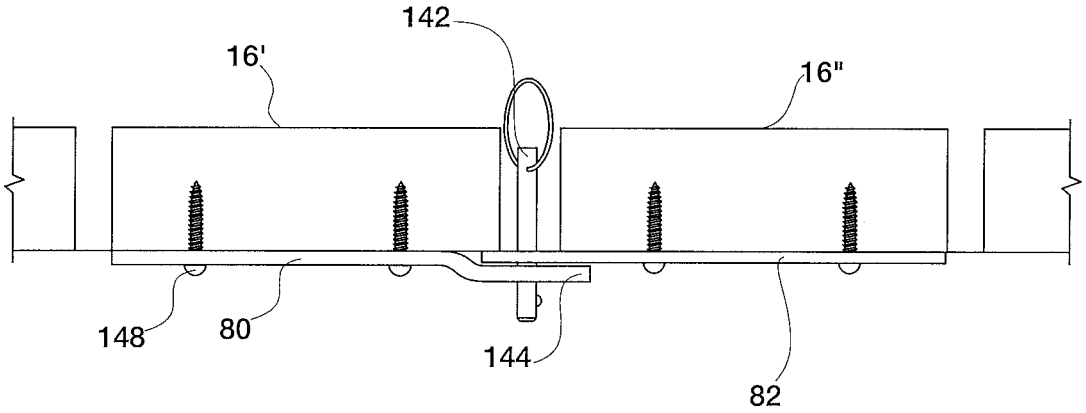
FIG. 12B is a side elevational view of the embodiment in FIG. 12A wherein the first lock piece is connected with the second lock piece.
Figure 13A:
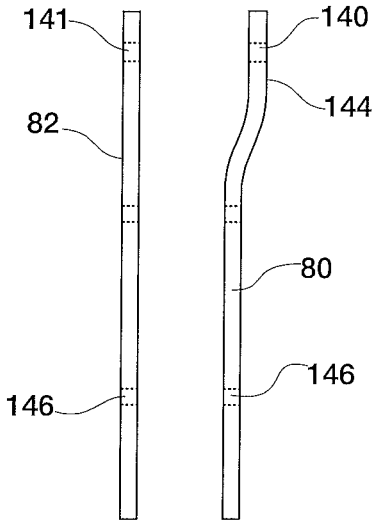
FIG. 13A is a side elevational view of the first lock piece and second lock piece.
Figure 13B:
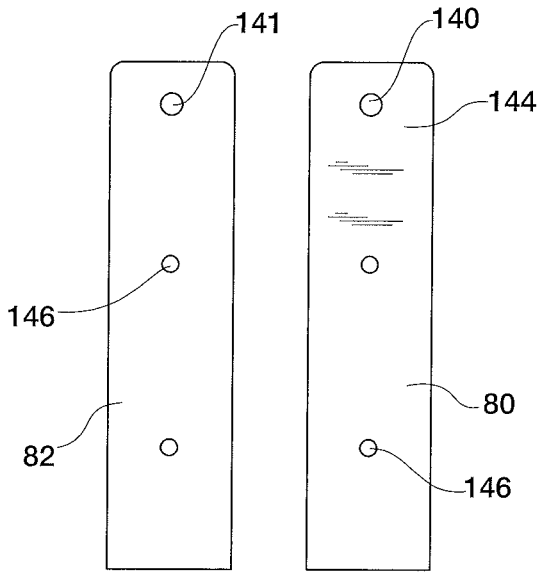
FIG. 13B is a front elevational view of the first lock piece and second lock piece.

FIGS. 12A and 12B illustrate another embodiment of ways to join two tables, including a first lock piece 80 and a second lock piece 82 constructed according to another embodiment. In the example shown, first lock piece 80 and second lock piece 82 comprise rigid materials having holes 140 and 141, respectively, which can be aligned to permit pin 142 to be inserted. Each lock piece includes holes 146 for mounting onto backrest 16 using fasteners 148. First lock piece 80 has a bend toward its distal end 144 enabling second lock piece 82 to overlap it. In the embodiment shown, first and second lock pieces comprise a metal alloy.

In operation, the present invention may also be considered a method for converting a bench into a picnic table. For example, the method includes rotating backrest 16 of seating assembly 10 from a vertical orientation to a horizontal position that is substantially parallel to the ground, thereby functioning as a tabletop. Rotation is accomplished via pivot points 32 between the backrest 16 and mounting posts 26. The pivot point 32 may be shared between mounting post 26 and base 30 installed onto backrest 16, or between mounting post 26 and backrest 16 directly. Once backrest 16 is in the horizontal position, locking pins 36 are inserted into a hole 136 found on each mounting post 26. Locking pins 36 function to provide support to backrest 16 while it remains in a horizontal position. Preferably, hole 136 is located so that the base 30 bears against both the pins 36 and tops 122, preventing wobble of the tabletop.

Similarly, the present invention may also be considered a method for converting a picnic table into a bench. For instance, if seating assembly 10 is in a table configuration, then locking pins 36 are removed so that backrest 16 may rotate. A user (or gravity) then rotates backrest 16 from its horizontal position to a vertical position using pivot pins 32 installed on mounting posts 26. As backrest 16 moves to a vertical position, recesses 34 receive a portion of backrest 16 and prevent backrest 16 from tilting further. Thus, recesses 34 may be sloped accordingly by the manufacturer depending on the desired tilt angle for backrest 16 when in the bench configuration. As seen in FIG. 1, recess 34' has a slope of about 30°. The secondary portion of recess 34" that supports backrest 16 may also have a slope to accommodate base 30. In the embodiment of FIG. 1, the secondary portion of recess 34 is about 10°.

The method may further include steps for converting two assemblies into a full-sized picnic table. For example, while seating assembly 10' is in a table configuration, a user aligns an end of the horizontal tabletop with an end of a second tabletop and securing the end of the horizontal table top with the end of the second tabletop of seating assembly 10" to form a full-sized table 100. Securing the ends may be accomplished by connecting a first lock piece on the end of the horizontal table top with a second lock piece on the end of the second tabletop.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A seating assembly comprising:

a bench having a bench configuration and a table configuration comprising a seat with two front legs and two rear legs, the two rear legs extending above the seat, and a backrest mounted onto a spaced-apart pair of bases that have holes and that are mounted on respective ones of the two rear legs, each rear leg including a recess having a shape configured to receive a portion of one of the spaced-apart pair of bases, the portion of one of the spaced-apart pair of bases having a geometry that substantially matches the shape of the recess to support the backrest in the bench configuration;

a pair of mounting posts installed adjacent to respective ones of the two rear legs to hold respective ones of the bases, the mounting posts having holes, and pivot pins extending through the holes on each mounting post and extending through the holes on one of each of the pair of bases;

wherein the backrest and the spaced-apart pair of bases can rotate about the pivot pin to switch between the bench configuration and the table configuration, and a locking assembly configured to secure the backrest in position when the bench is in the table configuration to support the spaced-apart pair of bases horizontally.

2. The seating assembly as claimed in claim 1, wherein the seating assembly is comprised of wood.

3. The seating assembly as claimed in claim 1, wherein the seat comprises a plurality of boards mounted to span a pair of lateral trusses that are supported by the two front legs and the two rear legs.

4. The seating assembly as claimed in claim 3, wherein the pair of mounting posts are supported on the pair of lateral trusses.

5. The seating assembly as claimed in claim 1, wherein each of the mounting posts comprises a wooden board inserted into a plastic cap.

6. The seating assembly as claimed in claim 5, wherein the plastic cap includes holes for the pivot pins to extend through.

7. The seating assembly as claimed in claim 1, wherein the spaced-apart pair of bases have a front face and a bottom face, and the front face is at an angle greater than 90° to the bottom face.

8. The seating assembly as claimed in claim 1, wherein the spaced-apart pair of bases are located adjacent to interior faces of the pair of mounting posts.

9. The seating assembly as claimed in claim 1, wherein each base of the spaced-apart pair of bases comprises two base elements that straddle an upper end of one of the pair of mounting posts.

10. The seating assembly as claimed in claim 1, wherein the spaced-apart pair of bases comprise plastic.

11. The seating assembly as claimed in claim 1, wherein the backrest comprises a plurality of boards spanning the spaced-apart pair of bases.

12. The seating assembly as claimed in claim 1, wherein the locking assembly comprises a pair of locking pins configured to be inserted in holes in the pair of mounting posts when the bench is in the table configuration to support the spaced apart pair of bases horizontally.

13. The seating assembly as claimed in claim 12, wherein the locking pins are chained to the seat assembly.

14. The seating assembly as claimed in claim 1, wherein the locking assembly comprises a bolt action lock assembly comprising a locking pin configured to be inserted into a slot in each base of the spaced-apart pair of bases adapted to be movable between a first position and a second position, the first position enabling the backrest and the spaced-apart pair of bases to rotate between the bench configuration and the table configuration, and the second position securing the backrest when the bench is in the table configuration to support the spaced-apart pair of bases horizontally.

15. The seating assembly as claimed in claim 1 further including a first lock piece on the backrest configured to connect with a second lock piece on a backrest of a second seating assembly to form a full-sized table.

16. The seating assembly as claimed in claim 15, wherein the first lock piece includes a hook and the second lock piece includes a recess adapted to receive the hook of the first lock piece.

17. The seating assembly as claimed in claim 16 further including a ridge on the second lock piece adapted to retain the hook of the first lock piece.

18. The seating assembly as claimed in claim 17 further including a spacing on the second lock piece adapted to enable a user to push on the second lock piece to release the hook from the ridge and the recess.

19. The seating assembly as claimed in claim 15, wherein the first lock piece and the second lock piece are configured to overlap with one another forming a hole.

20. The seating assembly as claimed in claim 19 further including a pin inserted into the hole formed from the first lock piece and the second lock piece securing the backrest to the second seating assembly and forming a full-sized table.

21. A seating assembly comprising:

a bench having a bench configuration and a table configuration comprising a seat with two front legs and two rear legs and a backrest component, the backrest component comprising a plurality of boards mounted onto two spaced-apart pairs of bases on each end of the plurality of boards, each base having a hole, a front face and a bottom face with the front face at an angle greater than 90° to the bottom face, each rear leg of the two rear legs of the bench including a recess having a shape adapted to receive a portion of one of the spaced-apart pair of bases, the portion of one of the spaced-apart pair of bases having a geometry that substantially matches the shape of the recess to support the backrest component in the bench configuration;

a pair of mounting posts installed adjacent to respective ones of interior faces of the two rear legs of the bench for securing the backrest component in both configurations, wherein each base of the spaced-apart pair of bases is separated by a distance adapted to receive an upper end of one post of the spaced-apart pair of mounting posts;

pivot pins inserted through the hole in one post of the spaced-apart pair of mounting posts and extending through the hole in one of each of the spaced-apart pairs of bases; and locking pins positioned to extend through each mounting post, each locking pin configured to be inserted when the backrest component is in the table configuration to support the spaced-apart pair of bases.

22. A method for converting a backrest of a bench into a table comprising the acts of:

orienting a backrest mounted on a pivot on a pair of mounting posts installed adjacent to a pair of rear legs in an inclined position to serve as a backrest such that a shaped portion of the backrest is supported in a recess in the rear leg that has a shape that substantially matches the shape of the shaped portion of the backrest;

rotating the backrest to a horizontal position substantially parallel to the ground; and inserting a pin into a hole on each pair of mounting posts so the backrest is at least partially supported on the pins.

23. A method for converting a picnic table into a bench comprising the acts steps of:

removing a supporting pin from a pair of mounting posts installed adjacent to a pair of rear legs;

rotating a horizontal tabletop about a pivot point points on the pair of mounting posts to an inclined vertical position to place the tabletop so shaped portions of the tabletop are at least partially supported in recesses in the pair of rear legs that have a geometry that substantially matches the shape of the shaped portion of the tabletop.

24. The method as claimed in claim 23, further including the steps of:

aligning an end of the horizontal tabletop with an end of a second tabletop;

securing the end of the horizontal table top with the end of the second tabletop to form a full-sized table.

25. The method as claimed in claim 24, wherein the step of securing the ends comprises connecting a first lock piece on the end of the horizontal table top with a second lock piece on the end of the second tabletop.

* * * * *